United States Patent [19]

Komatsu et al.

[11] Patent Number: 4,637,927

[45] Date of Patent: Jan. 20, 1987

[54] PROCESS FOR ACCELERATING OF AMORPHIZATION OF INTERMETALLIC COMPOUNDS BY A CHEMICAL REACTION USING LATTICE DEFECTS

[75] Inventors: Masao Komatsu, Higashi-Osaka; Hiroshi Fujita, Ibaraki, both of Japan

[73] Assignee: Osaka University, Suita, Japan

[21] Appl. No.: 711,441

[22] Filed: Mar. 12, 1985

[30] Foreign Application Priority Data

Sep. 14, 1984 [JP] Japan ..... 59-191644

[51] Int. Cl.[4] ..... C01B 6/24

[52] U.S. Cl. ..... 423/644; 148/20.3; 148/403; 420/900

[58] Field of Search ..... 423/644; 148/20.3, 403; 420/900

[56] References Cited

U.S. PATENT DOCUMENTS 4,231,816 11/1980 Cuomo et al. ..... 148/403

4,557,765 12/1985 Mori et al. ..... 148/403

FOREIGN PATENT DOCUMENTS 8402926 8/1984 World Int. Prop. O. ..... 148/403

*Primary Examiner*—H. T. Carter

*Attorney, Agent, or Firm*—Spencer & Frank

[57] ABSTRACT

Amorphization of intermetallic compounds of Zr-Al alloys is accelerated by arranging previously and artificially the lattice defects at given positions in the crystals.

14 Claims, 5 Drawing Figures

AMORPHIZATION of Zr–Al alloys by absorbing Hz gas.

PROCESS FOR ACCELERATING OF AMORPHIZATION OF INTERMETALLIC COMPOUNDS BY A CHEMICAL REACTION USING LATTICE DEFECTS

BACKGROUND OF THE INVENTION

1. Field of the Invention

The present invention relates to a process for accelerating amorphization of metals useful in material engineering. More particularly, the present invention relates to a process for accelerating amorphization of intermetallic compounds by a chemical reaction using lattice defects.

2. Description of the Prior Art

Amorphous metals are of interest as new materials rich in functional properties in wide fields of engineering because of their excellent physical and chemical properties.

For production of these amorphous metals, two methods have been established: rapid cooling of liquid metal and vapor deposition of metal. Of these methods, the method of rapid cooling of liquid metal has become a main pathway recently and is able to provide an amorphous metal. Further, by the method of vapor deposition of metal, the metal vapor which is produced by heating and evaporating the metal in vacuo is applied onto a substrate maintained at the temperature of liquid helium or liquid nitrogen to obtain the amorphous metal.

The method of rapid cooling of liquid metal has the following problems: (1) the products are limited to ribbons or lines and it is impossible to amorphize a thick part or a required part, and (2) the fields of use are narrowly limited because of the difficulty in controlling the rate of rapid cooling.

Further, the method of vapor deposition is unable to prepare a thicker product than a product obtained from the method of rapid cooling of liquid, so that the obtained product has a very high cost.

SUMMARY OF THE INVENTION

The present invention is a process for accelerating amorphization of intermetallic compounds. For this purpose, firstly, intermetallic compounds are obtained by adding a metal element to another single metal which usually forms a tightly bonded hydride. After lattice defects are introduced into the intermetallic compounds, the compounds are subjected to a chemical reaction by adding hydrogen and are amorphized, i.e., regions of amorphous hydrides of the treated intermetallic compounds are produced. In this case, since hydrogen is preferentially and rapidly absorbed and diffused in materials along the lattice defects, various lattice defects are previously introduced into the materials under given conditions so that amorphous phases having any form or volume are formed in the materials. This method can also prepare amorphous materials having sufficient thicknesses which are unable to be obtained by the other method.

Namely, the present invention is a process for amorphization of intermetallic compounds by absorbing hydrogen and by a chemical reaction. By specifying the density and configuration of lattice defects, such as dislocations, crystal boundaries, homogeneous interfaces, etc., which are previously and artificially introduced in regions which are to be made amorphous in crystals, amorphous regions having any form and density in the crystals are directly formed, so that amorphous phases having sufficient thicknesses are obtained.

Accordingly, the present invention is characterized by the steps comprising: using Zr-Al alloys as metals, treating the alloys so as to artificially arrange the lattice defects, and then forming amorphous regions by hydrogen absorption under a hydrogen gas atmosphere.

The present invention is described in detail with reference to the accompanying drawing.

DETAILED DESCRIPTION OF A PREFERRED EMBODIMENT

Figure 1A:
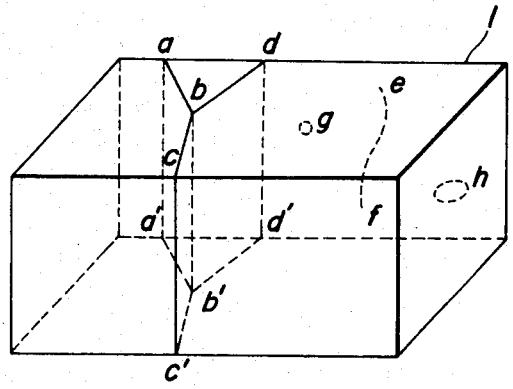
FIG. 1*a* is a schematic view of lattice defects in crystals of intermetallic compounds suitable for carrying out the present invention.

Referring to FIG. 1, at given positions in crystals of intermetallic compounds 1, lattice defects, such as crystal boundaries (a-b-b'-a', b-c-c'-b'and b-d-d'-b'), a dislocation line (e-f), a microdefect (g) and a dislocation loop (h), are artificially arranged. For arranging the lattice defects, techniques, such as cold or hot working, heat treatment, irradiation with particle beam, etc., are used.

Figure 2:
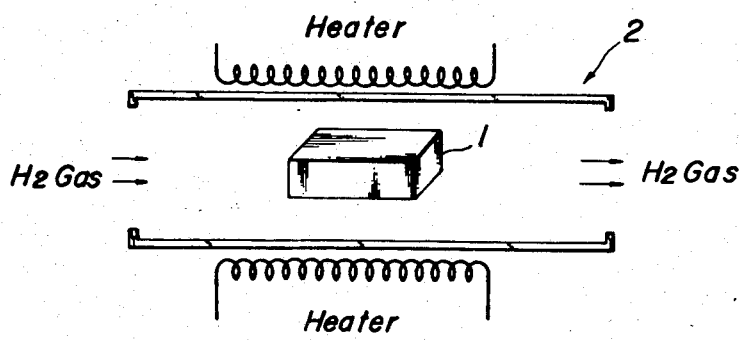
FIG. 2 is a schematic view of an electric furnace suitable for carrying out an embodiment of the present invention.

Then, these crystals 1 are treated by heating at a given temperature in a hydrogen-containing gas (pure $H_2$ gas, $H_2$ gas plus an inert gas, etc.) within an electric furnace 2 as shown in FIG. 2. The heating temperature and the heating time are variable according to the kinds and properties of the Zr-Al alloys and the lattice defects which were previously formed. For example, $Zr_3Al$ alloy is heat-treated at 350° K.–650° K., 900 sec and 1 atm, and $Zr_2Al$ alloy at 400° K.–700° K., 1,800 sec and 1 atm. By the heat treatment, the crystals preferentially absorb hydrogen near the lattice defects which were previously formed, and amorphous phases are obtained.

Figure 1B:
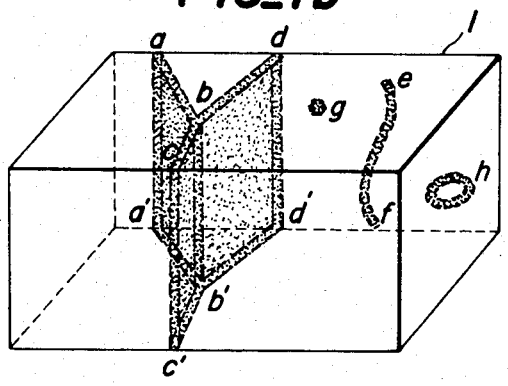
FIG. 1*b* is a schematic view of the amorphous phases formed by the present invention.

FIG. 1*b* shows the amorphous phases formed in the above lattice defects having the forms of films (a-b-b'-a', b-c-c'-b' and b-d-d'-b'), a string (e-f), a globe (g) and a ring (h), respectively. In this example, the amorphous region, taking the form of a film or a curved surface, may be formed by a cell wall or a sub-boundary which arranges dislocation lines as a group. Further, the thicknesses of the amorphous regions shown in FIG. 1*b* are freely controlled by controlling the hydrogen pressure of the surrounding gas, the temperature of hydrogen absorption and the time of hydrogen absorption.

The following examples are intended to illustrate this invention without limiting the scope thereof.

EXAMPLE 1

Figure 3:
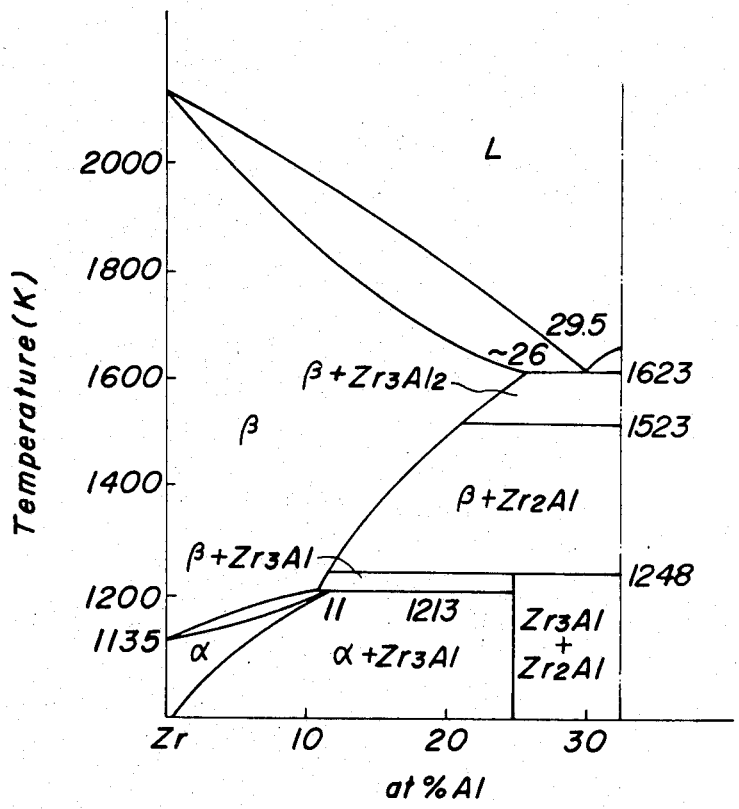
FIG. 3 is a phase diagram of Zr-Al alloys suitable for carrying out an embodiment of the present invention.

30 at % of aluminium and 70 at % of sponge zirconium were subjected to arc welding to form Zr-Al alloys. A phase diagram of the alloys is shown in FIG. 3.

Figure 4A:
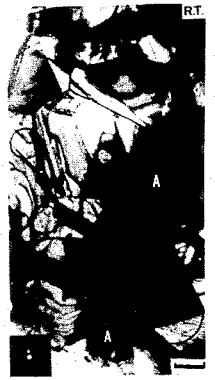
FIG. 4 is a sectional view of crystal structures photographed with an electron microscope before and after hydrogen absorption by Zr-Al alloys of an embodiment of the present invention.

The alloy plate was then cut into thin films having thicknesses of 0.2 mm with a discharge processing machine and electro-polished in a solution containing 9 parts of acetic acid and 1 part of perchloric acid to obtain a sample for an electron microscope. FIG. 4*a* shows a photograph of the structures of the obtained sample. Extended fine structures, i.e., lattice defects, are observed at places enclosed with circles. This sample was heat-treated at heating temperatures and heating times of 773° K.×0.9 ks (FIG. 4*b*), 823° K.×0.9 ks (FIG. 4*c*) and 873° K.×0.6 ks (FIG. 4*d*), successively, in an electric furnace having a surrounding gas of 0.1 MPa of Ar+10% $H_2$ so as to absorb hydrogen. Each time the sample was subjected to the heat treatment at each heating temperature, the sample was cooled to room temperature and the same portion observed within the same range of the electron microscope.

Figure 4B:
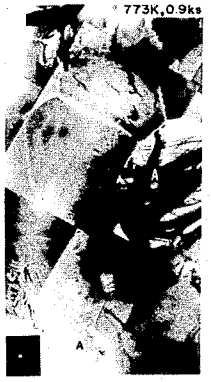

FIG. 4*b* shows that filmy structures having striking contrasts are produced at the places where the above-mentioned fine structures exist, and that, at the same time, hydrogen is gradually absorbed along defects which have the form of crystal boundaries, films or lines, seen as dislocation lines and which are formed by the heat treatment.

Figure 4C:
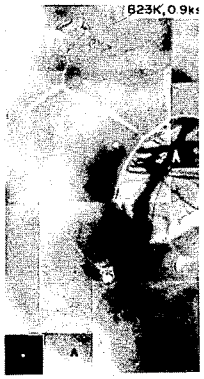
Figure 4D:
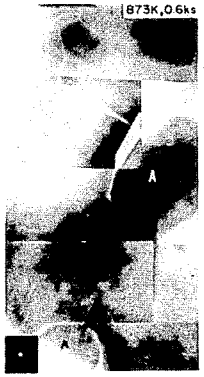

FIGS. 4*c* and *d* show that the whole $Zr_3Al$ part (except the part noted by A) changes to the amorphous phases when hydrogen absorption is accelerated. However, in the case of $Zr_2Al$ crystals (noted by A), the amorphization proceeds at an extremely thin edge (in the lower part of FIG. 4*c*) of the sample, while not yet proceeding at a somewhat thicker part (in the right center part) of the sample. FIG. 4*d* shows that the amorphization of $Zr_2Al$ may also proceed completely.

EXAMPLE 2

Zr-Al alloys were treated in order to arrange lattice defects therein in the same way described in the above example 1. The obtained samples were heat-treated at heating temperatures of 470° K.–873° K. and heating times of 0.9 ks–1.8 ks in a surrounding gas which contained $H_2$ of 1 atm. The samples were then cooled and the same portions observed within the same range of the electron microscope, repeatedly. Amorphization was recognized by observation of the sample changes due to the hydrogen absorption.

Summarizing the results of the examples: (1) In the crystals of Zr-Al alloys, hydrogen is rapidly absorbed along lattice defects, such as filmy structures, crystal boundaries and the like, preferentially. (2) The hydrogen absorption rate of $Zr_3Al$ crystals is faster than that of $Zr_2Al$ crystals. (3) By hydrogen absorption by the Zr-Al alloys, amorphous phases are obtained . (4) The amorphization of $Zr_3Al$ is easier than that of $Zr_2Al$. (5) The amorphization proceeds from a thin edge of the sample, and preferentially at regions having lattice defects, such as grain boundaries, dislocations and the like. (6) Neither of the amorphous Zr-Al alloys crystallize by simple annealing in vacuo at higher temperatures than the temperatures for heat treatment for hydrogen absorption.

The present invention utilizes the phenomenon that amorphous phases formed by hydrogen absorption are preferentially produced along lattice defects, in the form of lines and curved surfaces, in the crystals by controlling appropriately the conditions of hydrogen absorption. According to this method, an amorphous region having a given form at a given position in the crystals is obtained by controlling the arrangement of these lattice defects. Further, since hydrogen diffusion occurs easily and rapidly along the lattice defects, it is possible to prepare amorphous materials having sufficient thicknesses (1 cm or more) by the sufficient absorption of hydrogen.

Dislocations, which are one kind of lattice defect, act as nucleuses of amorphization, are able to form loops of several nm diameter or to be arranged at intervals of several nm or more. When dislocations are used as the nucleuses, it is possible to form amorphous balls of several nm diameter or to distribute amorphous columns of several nm diameter at intervals of several nm or more.

Further, when these various lattice defects are combined, amorphous regions having desired forms may be formed in crystals. This characteristic of the present invention is original because none of the desired amorphous phases are obtainable by conventional methods.

According to the present invention, there are many special advantages such as:

(1) Possibility of thickness (or size) control of the amorphous regions by controlling the conditions of hydrogen absorption.

(2) Availability of amorphous phases from any form, including extremely complex forms prepared by other methods.

(3) Excellent bonding between the amorphous regions and mother materials owing to the unchanged compositions of the alloys.

(4) Stability of the amorphous phases over a wide range of temperatures.

In addition, when the property of the amorphous phases of extreme brittleness is utilized, finely ground amorphous powder may be obtained by grinding the amorphous materials, and finely ground alloy powder from which hydrogen is released may be obtained by heating the amorphous materials at a higher temperature than the temperature of crystallization. Since the amorphous materials have a constant temperature of crystallization, they are repeatedly usable as the materials of hydrogen absorption from which hydrogen may be released at a constant temperature.

Consequently, the present invention has the following uses:

(1) Preparation of composites formed by the amorphous phases having any size and any form in the mother materials.

(2) Amorphization of surface phases or whole phases having complex forms obtained by other means.

(3) Preparation of amorphous materials having sufficient thicknesses.

(4) Preparation of a superfine ground powder.

(5) Hydrogen absorption using the solid from which hydrogen has been released at a given temperature.

What is claimed is:

1. A process for accelerating the amorphization of intermetallic compounds by a chemical reaction, said process comprising:

a. alloying a mixture consisting essentially of zirconium and aluminum to form intermetallic compounds thereof;

b. treating said intermetallic compounds to provide lattice defects therein; and c. reacting said treated intermetallic compounds at an elevated temperature in a reaction chamber with a gas including hydrogen gas to produce regions of amorphous hydrides of said treated intermetallic compounds, at least at said lattice defects, said elevated temperature ranging from a temperature effective to cause said chemical reaction to a temperature which does not equal or exceed the temperature at which said regions of amorphous hyrides crystallize.

2. A process according to claim 1, wherein said lattice defects are provided at select positions within said intermetallic compound and in select configurations and densities, whereby said regions of amorphous hydrides are produced at select positions and in select configurations and densities, respectively.

3. A process according to claim 2, wherein said defect configurations are selected from the group consisting of dislocations, dislocation lines, dislocation loops, dislocation films, dislocation curved surfaces, microdefects, crystal grain boundaries and homogeneous interfaces.

4. A process according to claim 1, wherein said mixture contains from 1 to 32 atomic % aluminum.

5. A process according to claim 1, including the further step of grinding the amorphous hydrides of said intermetallic compounds into a fine powder after the reacting step.

6. A process according to claim 1, wherein said elevated temperature does not exceed 873° K.

7. A process according to claim 1, wherein said elevated temperature ranges from 350° to 873° K.

8. A process according to claim 1, wherein said gas passes through said reaction chamber and has a pressure for hydrogen of up to about 1 atm.

9. A process according to claim 1, wherein the reacting step has a heating time of from 10 to 30 minutes.

10. A process according to claim 1, wherein said treating step is accomplished by one of cold working, hot working, heat treating and particle beam irradiation.

11. Intermetallic compounds having regions of amorphous hydrides thereof prepared by a process for accelerating the amorphization of intermetallic compounds by a chemical reaction, said process comprising:

a. alloying a mixture consisting essentially of zirconium and aluminum to form intermetallic compounds thereof;

b. treating said intermetallic compounds to provide lattice defects therein; and c. reacting said treated intermetallic compounds at an elevated temperature in a reaction chamber with a gas including hydrogen gas to produce regions of amorphous hydrides of said treated intermetallic compounds at least at said lattice defects, said elevated temperature ranging from a temperature effective to cause said chemical reaction to a temperature which does not equal or exceed the temperature at which said regions of amorphous hydrides crystallize.

12. A process for accelerating the amorphization of intermetallic compounds by a chemical reaction, said process comprising:

a. alloying a mixture consisting essentially of zirconium and aluminum to form intermetallic compounds thereof;

b. treating said intermetallic compounds to provide lattice defects therein, wherein said treating step is accomplished by one of cold working, hot working, heat treating and particle beam irradiation; and c. reacting said treated intermetallic compounds at an elevated temperature in a reaction chamber with a gas including hydrogen gas to produce regions of amorphous hydrides of said treated intermetallic compounds at least at said lattice defects, said elevated temperature ranging from a temperature effective to cause said chemical reaction to a temperature which does not equal or exceed the temperature at which said regions of amorphous hyrides of said treated intermetallic compounds crystallize.

13. A process according to claim 12, wherein said lattice defects are provided at select positions within said intermetallic compound and in select configurations and densities, whereby said regions of amorphous hydrides are produced at select positions and in select configurations and densities, respectively.

14. A process according to claim 13, wherein said defect configurations are selected from the group consisting of dislocations, dislocation lines, dislocation loops, dislocation films, dislocation curved surfaces, microdefects, crystal grain boundaries and homogeneous interfaces.

* * * * *